US009577365B1

(12) United States Patent
Herbrechtsmeier et al.

(10) Patent No.: US 9,577,365 B1
(45) Date of Patent: Feb. 21, 2017

(54) HOLDING FRAME FOR HOLDING PLUG CONNECTOR MODULES

(71) Applicant: HARTING ELECTRIC GMBH & CO. KG, Espelkamp (DE)

(72) Inventors: Heiko Herbrechtsmeier, Buende, DE (US); Heiko Meier, Minden (DE); Alexander Schoenfeld, Osnabrueck (DE)

(73) Assignee: HARTING ELECTRIC GMBH & CO. KG (DE)

( * ) Notice: Subject to any disclaimer, the term of this patent is extended or adjusted under 35 U.S.C. 154(b) by 0 days.

(21) Appl. No.: 14/945,239

(22) Filed: Nov. 18, 2015

(30) Foreign Application Priority Data

Sep. 3, 2015 (DE) ..... 10 2015 216 929

(51) Int. Cl.
*H01R 13/60* (2006.01)
*H01R 13/66* (2006.01)
*H01R 13/518* (2006.01)
*H01R 13/514* (2006.01)

(52) U.S. Cl.
CPC ..... *H01R 13/518* (2013.01); *H01R 13/514* (2013.01)

(58) Field of Classification Search
CPC ..... H01R 13/518; H01R 13/514
USPC ..... 439/532, 701, 716, 540.1
See application file for complete search history.

(56) References Cited

U.S. PATENT DOCUMENTS

| | | | | |
|---|---|---|---|---|
| 6,004,162 | A | 12/1999 | Harting | 439/701 |
| 7,322,842 | B2 * | 1/2008 | Duck | G02B 6/381 200/51.03 |

FOREIGN PATENT DOCUMENTS

| | | | |
|---|---|---|---|
| CN | 202084755 | 12/2011 | H01R 13/514 |
| CN | 202352910 | 7/2012 | H01R 13/518 |
| CN | 204271392 | 4/2015 | H01R 13/518 |
| DE | 19707120 | 6/1998 | H01R 13/514 |
| DE | 202012103360 | 1/2013 | H01R 13/514 |
| EP | 0860906 | 8/1998 | H01R 13/514 |

OTHER PUBLICATIONS

PCT Written Opinion (w/translation) issued in application No. PCT/EP2016/068430, dated Nov. 28, 2016 (14 pgs).

* cited by examiner

*Primary Examiner* — Javaid Nasri
(74) *Attorney, Agent, or Firm* — Hayes Soloway P.C.

(57) ABSTRACT

Disclosed is a holding frame for holding plug connector modules, in particular for installation in plug connector casings and/or for screwing onto wall surfaces. In order to allow improved handling and more reliable populating and assembly of the holding frame having frame halves. The holding frame has an elastic fixing element adapted to releaseably fix the frame halves in a plug-in state and a holding state. At least a restoring force of the elastic fixing element must be overcome in order to release the fixing and/or to switch between the plug-in state and the holding state.

19 Claims, 8 Drawing Sheets

HOLDING FRAME FOR HOLDING PLUG CONNECTOR MODULES

FIELD OF THE INVENTION

The invention relates to a holding frame for holding plug connector modules, in particular for installation in plug connector casings and/or for screwing onto wall surfaces, wherein said plug connector modules are inserted into the holding frame, and holding means on the plug connector modules, for example, cooperate with recesses which are provided on opposite wall parts (side parts) of the holding frame. The invention also relates to a corresponding production method and to a method for populating such a holding frame.

BACKGROUND OF THE INVENTION

Holding frames of this kind are used for holding plug connector modules, the holding frame being populated with different plug connector modules and subsequently inserted to into a plug connector casing and fastened thereto. The holding frame must be mechanically stable in order to withstand the insertion and withdrawal forces that arise when forming or separating the plug connection.

A substantially rectangular holding frame provided with side walls extending at right angles to the mounting plane is known from the document entitled "Schwere Steckverbinder, Han-Modular, 16 3" published by the firm of HARTING Elektronik GmbH. The plug connector modules are provided with detent hooks which snap into the side walls when the plug connector modules are inserted into the holding frame, and are thus held securely in the latter.

Only with special removal tools is it then possible to replace the plug connector modules. i.e. to remove or release them.

A development of that solution is described in DE 197 07 120 C1 and EP 0 860 906 A2, in which a holding frame is disclosed. The object of the invention disclosed in DE 197 07 120 C1 and EP 0 860 906 A2 is that the plug connector modules can be installed and dismounted in the simplest possible manner. However, the intention is nevertheless to ensure that the holding frame has a high level of mechanical stability in order to withstand the insertion and withdrawal forces that arise when forming or separating the plug connection.

The holding frame described therein consists of two frame halves which are connected to each other by hinges and have fastening ends provided with fastening screws. The hinges are provided at the fastening ends of the holding frame, and the frame halves are able to pivot transversely to the side parts of the holding frame. To form the hinges, moulded portions which engage in matching recesses are provided in each case at the fastening ends of the holding frame or of the side parts.

There are known problems that arise when populating the holding or articulated frame disclosed in DE 197 07 120 C1 or EP 0 860 906 A2, and inserted modules may inadvertently jump out of their holders during installation. A separate component is already being used to counteract such inadvertent detachment of modules once they have been inserted, but that component can be lost.

The object of the present invention is to develop the holding frame known from the prior art in such a way that these known problems are surmounted or at least mitigated, the specific aim being to provide improved handling and a more reliable way of populating and mounting the holding frame.

SUMMARY OF THE INVENTION

According to a first aspect of the invention, a holding frame for holding plug connector modules is proposed, wherein said plug connector modules are insertable into the holding frame, and holding means on the plug connector modules cooperate with holding means which are provided on opposite side parts of the holding frame, wherein the holding frame includes two frame halves articulatedly connected to each other at fastening ends of the holding frame, the holding frame being divided along a line parallel to the side parts of the holding frame, the articulated connection allowing the holding frame a plug-in state and a holding state, the frame halves in the plug-in state being pivoted in relation to each other about a longitudinal axis in such a way that one or more plug connector modules can be introduced between the side parts, and the frame halves in the holding state being pivoted in such a way relative to the plug-in state that one or more inserted plug connector modules have a form-locking connection with the holding frame. The holding frame is characterised in that the holding frame has an elastic fixing element adapted to releaseably fix the frame halves in the plug-in state and the holding state, wherein a restoring force of the elastic fixing element must be overcome at least in order to release the fixing and/or to switch between the plug-in state and the holding state.

According to a second aspect of the invention, a method for producing a holding frame for holding plug connector modules is proposed, such that the plug connector modules are insertable into the holding frame and holding means on the plug connector modules can cooperate with holding means which are provided on opposite side parts of the holding frame. The method comprises the steps of providing two frame halves each comprising one side part of the holding frame, articulatedly connecting the frame halves to each other along the side parts of the holding frame at fastening ends, the articulated connection allowing a plug-in state and a holding state of the holding frame, the frame halves in the plug-in state being pivoted in relation to each other about a longitudinal axis in such a way that one or more plug connector modules can be introduced between the side parts, the frame halves in the holding state being pivoted in such a way relative to the plug-in state that one or more inserted plug connector modules have a form-locking connection with the holding frame. The method is characterised by affixing an elastic fixing element adapted to releaseably fix the frame halves in the plug-in state and the holding state, wherein at least a restoring force of the elastic fixing element must be overcome in order to release the fixing and/or to switch between the plug-in state and the holding state, the elastic fixing element being affixed by a form-locking, force-locking and/or material-fit connection.

According to a third aspect of the invention, a method for populating a holding frame with plug connector modules is proposed, wherein the holding frame includes two frame halves, the holding frame being divided along a line parallel to the side parts of the holding frame. The method comprises the steps of providing a plug-in state of the holding frame, the frame halves articulatedly connected to each other at fastening ends of the holding frame in the plug-in state being pivoted in relation to each other about a longitudinal axis in such a way that one or more plug connector modules can be introduced between the side parts, wherein providing the plug-in state includes releaseably fixing the frame halves to each other by means of an elastic fixing element, populating the holding frame in the plug-in state with one or more plug connector modules and providing a holding state of the holding frame by pivoting the frame halves relative to the plug-in state, so that the one or more inserted plug connector modules have a form-locking connection with the holding frame via holding means on the plug connector modules and via holding means which are provided on opposite side parts of the holding frame, wherein providing the holding state includes releaseably fixing the frame halves to each other by means of the elastic spring element, wherein providing the holding state at least includes overcoming a restoring force of the elastic fixing element in order to release the fixing in the plug-in state and/or to switch between the plug-in state and the holding state.

It has been found that the problems which arise with the holding or articulated frame disclosed in DE 197 07 120 C1 or EP 0 860 906 A2 arise because there is no clearly defined and (more or less) securely fixed position for the open state, in which the modules are to be mounted. This results in what is sometimes rather cumbersome installation. Likewise, there is no securely fixed state for the closed state unless the separate component is attached, although that makes handling additionally complicated.

In this context, the inventors set themselves the aim of providing two precisely defined positions for the holding frame. In the open position, the modules are to be mountable in an optimum manner, with the frame being fixed in that position. In the closed position, the mounting frame is to be prevented from inadvertently opening again once the modules have been inserted.

The plug-in state and the holding state are each preferably defined constructionally by the design of the frame halves, that is to say, parts of the frame halves abut each other in each respective state, thus preventing any further pivoting beyond the holding state or the plug-in state. However, such restriction can also be achieved by designing the elastic fixing element accordingly. The holding state and/or the plug-in state can also be determined, however, by selecting suitable detent positions or the like, without pivoting beyond the respective state being necessarily impossible.

In one advantageous embodiment of the invention, the elastic fixing element includes a spring plate which is mounted on one frame half and comprises a detent member for engagement with an engagement member of the other frame half.

In this context, the spring plate can act in at least two ways. One way is that the spring plate itself acts on the other frame half by its spring force, in order to hold the frame halves in at least one of the two states, the holding state or the plug-in state, with its spring force. Another way of acting is that the spring plate keeps the detent member engaged via its spring force. These ways of acting can also be combined.

In one variant of the embodiment mentioned above, the spring plate is designed a) to cause a restoring force in the direction of the holding state when in a state between the plug-in state and the holding state, and the detent member is designed to engage with the engagement member in the plug-in state, or the spring plate is designed b) to cause a restoring force in the direction of the plug-in state when in a state between the plug-in state and the holding state, and the detent member is designed to engage with the engagement member in the plug-in state.

The spring plate may, for example, be substantially relaxed when in the holding state (or have a tension that keeps the holding state in a stop member between the frame halves), the spring plate being deformed, and thus (further) tensioned, by pivoting the frame halves in relation to each other to form the plug-in state. In this (tensioned) plug-in state, said state can then be secured by engagement of the detent member and the engagement member.

In another variant or modification of the above variant, a restoring force of the spring plate must be counteracted in order to release the engagement of the detent member and the engagement member.

In the example described above, engagement is preferably secured by the restoring force of the spring plate.

Alternatively or additionally thereto, the spring plate can hold the detent member and the engagement member in a form-locking connection (e.g. as a pin and hole), this form-locking connection being released by deforming the spring plate, such deformation being unrelated to any transition between the plug-in state and the holding state. An example of this is a spring plate which is mounted at one (or both) fastening end(s) of a frame half and which has two holes in one portion extending to the other frame half, into which holes a pin or some other similar projection on the other frame half extends in a form-locking manner in order to secure the respective state. Proceeding from the plug-in state, for example, in which the pin is in form-locking engagement with a hole, the spring plate can be lifted in the region of the pin from the other frame half such that the hole and the pin are no longer in engagement with each other. If the holding frame is then brought from the plug-in state to the holding state, the spring can be relaxed again so that the pin engages with the other hole. The pin and the holes can also be designed in such a way that when a particular force is applied, it is possible for the spring plate to be lifted due to a geometrical configuration (e.g. a kind of ramp), even if this is not form-locking engagement in the strict sense, but only force-locking engagement. However, there may still be form-locking engagement, even in the strict sense, if exertion of a force on the frame halves initially causes a deformation of the spring plate, with which the geometrical design first achieves its effect.

It is also possible that there are two different ways of counteracting a restoring force of the spring plate in order to release the engagement. A first way is to lift the spring plate in the manner described above, so that the detent member and the engagement member are spatially separated from each other in different planes. Another way consists in the spring plate not only being deformable in a direction transverse to its surface (for example parallel to the longitudinal axis of the holding frame if arranged on the side of the fastening end or if mounted on the top or bottom side parallel to the insertion direction of the plug-in modules), but also being deformable in the same plane as its surface. If the spring plate has an L-shape, for example, such that the leg of the "L" is force-lockingly engaged via a flat notch, for example, with a pin on the other frame half, then the angle of the "L" can be spread apart or compressed by applying a sufficiently large force, so that the pin leaves the notch and can move to another notch, for example.

In another variant or modification of the above variants, the other frame half has a first and a second engagement member, and the detent member is designed to engage with the first and the second engagement member, or the spring plate has a second detent member.

In this way, by providing a suitable combination of engagement members and detent member or members, a fixing engagement can be provided in both the plug-in state and the holding state.

In a further embodiment, although one which can be combined with the above embodiment and its various variants and modifications, the articulated connection is so designed that a distance between a first section of the one frame half and a second section of the other frame half adopts an extreme value during a transition between the plug-in state and the holding state, the first and the second section being coupled to each other via the elastic fixing element.

When transitioning from one state to the other, the elastic fixing element is compressed or stretched to the relative position of the holding frames corresponding to the extreme value, so that a force acts in each case to restore the initial state. Not until the extreme position is overcome is the restoring force of the elastic fixing element, acting in the reverse direction, in the direction of the new state.

In a further embodiment, although one which can be combined with the above embodiments and their various variants and modifications, a first section of the one frame half and a second section of the other frame half are coupled to each other via the elastic spring element, a pivot axis of the articulated connection being located between a connecting line between the first and the second section in the plug-in state, and a connecting line between the first and the second section in the holding state.

If, for example, the connecting line or line of action of the elastic fixing element in the holding state is above the pivot axis, then in order for pivoting to be possible, a force must first be exerted until the line of action goes through the pivot axis. After such a transition, the elastic fixing element acts in such a way that its restoring force supports further transition to the plug-in state (as the pivot axis is now below the line of action).

In one variant of the two embodiments described in the foregoing, the elastic spring element is a spring clip which is arranged, in particular, in a plane defined by a fixing element.

With a suitable spring clip, the embodiments can be advantageously realised, the end portions of the spring clip engaging at suitable positions of the frame halves. From the handling perspective, it is particularly advantageous in this regard when a substantially planar spring clip is arranged parallel to the end of the sides of the end portions of the frame halves, as the spring clip does not protrude from the frame half in that case, or only to an insignificant extent.

In another embodiment, although one which can be combined with the above embodiments and their various variants and modifications, the elastic fixing element includes a hinge portion and a detent portion, the hinge portion articulatedly connecting the frame halves to each other so that in the plug-in state a first hinge restoring force acts in the direction of the holding state and/or a second hinge restoring force acts in the holding state in the direction of the plug-in state, wherein in a detent position the detent portion holds the frame halves in the plug-in state against the first hinge restoring force, or in the holding state against the second hinge restoring force, and wherein the detent portion can be brought from the detent position into a released position against the detent restoring force, in which the detent portion allows a transition between the holding state and the plug-in state.

The hinge portion embodied as a part of the elastic fixing element portion (but not necessarily as an integral part) allows a force to be provided which is directly related to the relative pivoting of the frame halves, wherein said force can be used, e.g. in cooperation with a constructional stop member, to provide a defined holding and/or plug-in state. The plug-in state or the holding state can also be effected by the hinge portion being relaxed in that state. However, it is equally possible to use a force in the hinge portion, acting in the holding state and in the plug-in state, respectively, in cooperation with respective locking via the detent portion, to achieve such fixing.

In one variant of the above embodiment, the hinge portion and the detent portion are embodied together in one piece as elements of the elastic fixing element.

One embodiment of an elastic fixing element that provides both the hinge portion and the detent portion in one component, in particular a component made of one material, reduces the total number of components being used, thus reducing the amount of assembly of separately installed components when producing the holding frame.

It should be noted that the holding frame can still be fitted with two separate elastic spring elements, in particular at opposite ends in the longitudinal direction, even when the hinge portion and the detent portion are integrally provided in one elastic spring element. This applies regardless of the particular embodiment which is discussed here.

In another variant or modification of the above variant, the hinge portion is relaxed in the plug-in state or in the holding state, the detent portion being designed to fix the frame halves in place when the hinge portion is relaxed.

When the hinge portion is near its relaxed state, a restoring force of the hinge portion against a small deflection would be correspondingly small, so the definition of the respective state would be rather unsharp or soft. If there is additional fixing by the detent portion, the respective state can be sharply defined.

In yet another variant or modification of the above variant, the hinge portion is designed so that the plug-in state or the holding state is maintained by the first or second hinge restoring force.

It is possible to design the holding frame in such a way that the hinge portion is tensioned in the plug-in state or in the holding state, such that a force acts which would actually cause further pivotal spreading (in the plug-in state) or pivoting in the opposite direction (in the holding state), if the frame halves did not already abut each other. In such a case, a transition from the one respective state to the other state would involve a force acting against the force of the hinge portion, wherein said other state can be fixed by the detent portion.

In another embodiment of the invention, the elastic spring element connects the frame halves electrically to each other in the holding state at least.

In addition to the advantages in respect of handling, designing the spring element to electrically connect the frame halves allows a defined and reliable electrical contact between the frame halves. Known solutions for providing electrical contact have been achieved using additional components, but these have only addressed the electrical contact aspect and not any other structural or functional advantages. With this design, the invention allows an increase in reliability (above all with regard to PE contacts), combined with improved handling for the user, in just one multifunctional component or component complex.

It should be understood in that regard that an embodiment which is described in connection with a method according to the invention should also be understood as an embodiment of an apparatus according to the invention, and vice versa. Preferred and/or advantageous embodiments of the invention are derived not only from the definitions in the claims, but also from their further description and explanation. Like the other embodiments disclosed here, the embodiments can likewise be combined with each other, unless there are features which mutually exclude such combination.

BRIEF DESCRIPTION OF THE DRAWINGS

In the following, the invention shall be described in greater detail with reference to preferred embodiments and to the enclosed Figures, in which.

DETAILED DESCRIPTION OF THE DRAWINGS

Figure 1A:
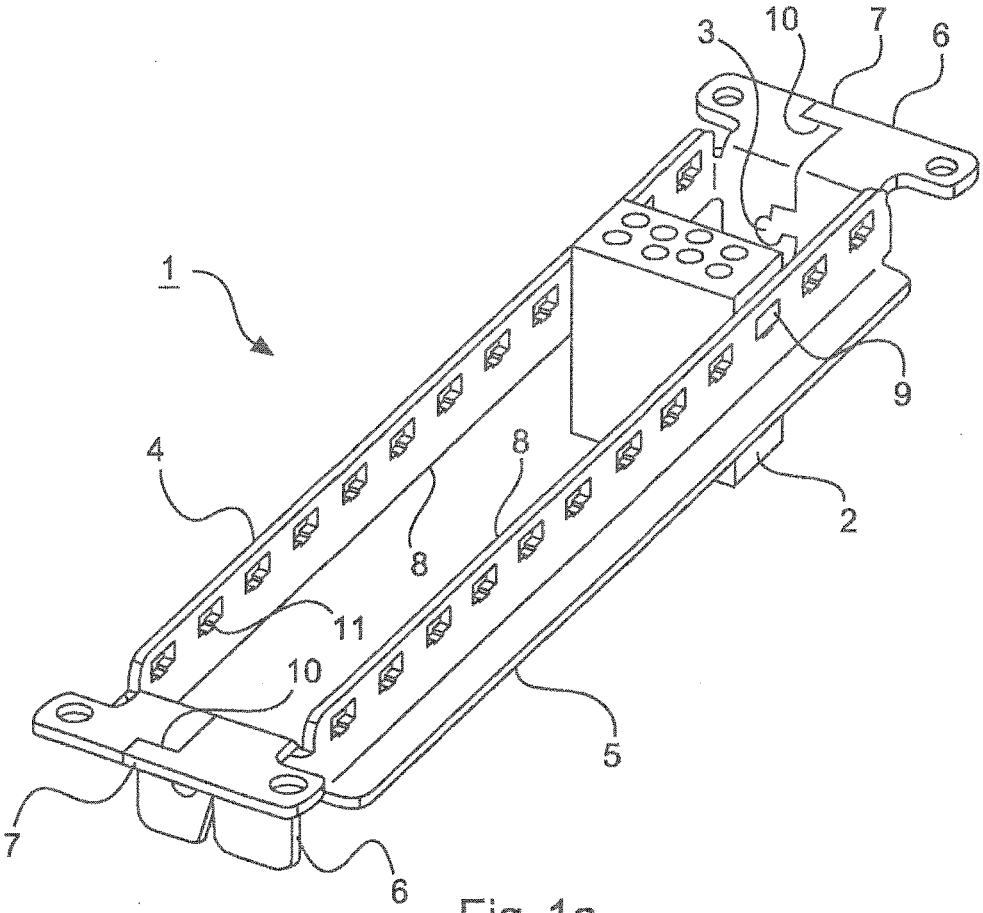
FIGS. 1*a* and 1*b* show views of a closed holding frame, without an elastic fixing element.
Figure 1B:
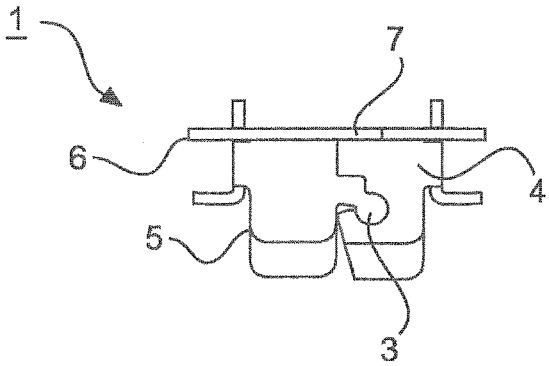
Figure 2A:
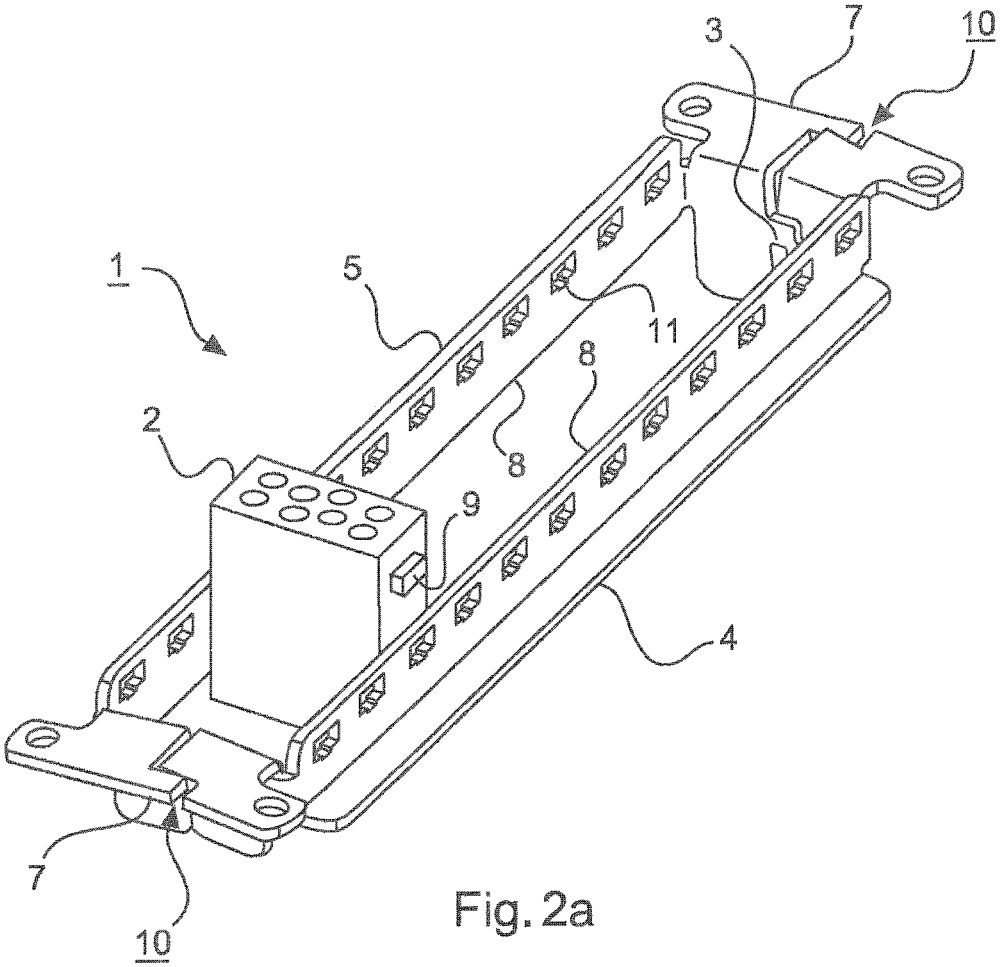
FIGS. 2*a* and 2*b* show views of the holding frame in FIGS. 1*a* and 1*b*, without an elastic fixing element, in the open state.
Figure 2B:
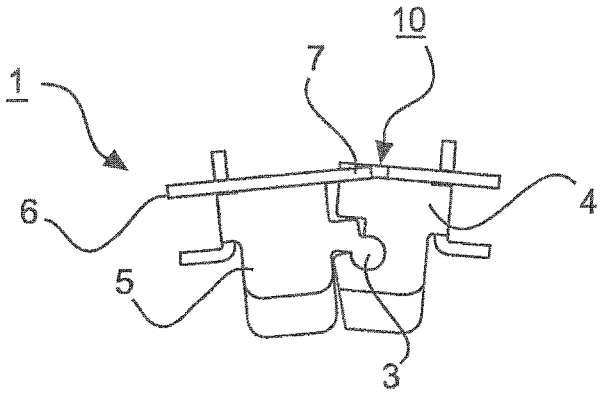

In FIGS. 1*a*, 1*b*, 2*a* and 2*b*, a holding frame 1 for plug connector modules 2 is shown schematically, the holding frame being open in FIGS. 2*a* and 2*b* and closed in FIGS. 1*a* and 1*b*.

Holding frame 1 is provided for installation, after insertion of plug connector modules 2, in a plug connector casing (see DE 197 07 120 C1 and EP 0 860 906 A2) or for fastening through a recess in an attachment surface or mounting wall.

Holding frame 1 consists of two frame halves 4, 5 connected via hinges 3 and having fastening ends 6 which can be provided with fastening screws (not shown), and side parts 8. Hinges 3 are provided at the fastening ends 6 of holding frame 1, and frame halves 4, 5 are able to pivot transversely to side parts 8 of holding frame 1 (as can be seen by comparing FIGS. 1*a*, 1*b* and 2*a*, 2*b*). To form hinges 3, moulded portions which engage in matching recesses are provided in each case at the fastening ends 6 of holding frame 1. After the moulded portion are inserted into the recesses, the side parts can be pivoted (rotatably) about the longitudinal axis.

Plug connector modules 2 are provided with projecting, approximately rectangular holding means 9 and may additionally have resilient detent hooks (not shown). Recesses 11, in the form of openings which are bounded on all sides, are provided in the side parts 8 of frame halves 4, 5, and holding means 9 are received in said recesses when plug connector modules 2 are inserted into holding frame 1.

To insert plug connector modules 2, holding frame 1 is unfolded, i.e. opened, frame halves 4, 5 being unfolded about hinges 3 to such an extent that plug connector modules 2 can be inserted.

For preliminary fixing of plug connector module 2, the detent hooks that may be provided initially engage, on insertion, under the lower edges of side parts 8 of frame halves 4, 5.

Frame halves 4, 5 are subsequently folded together, i.e. holding frame 1 is closed, with holding means 9 entering recesses 11 in the process and producing secure, form-locking retention of plug connector modules 2 in holding frame 1.

Fastening ends 6 each have a fastening section extending in the unscrewed state (see FIGS. 1*a* and 1*b*) parallel to fastening surface (not shown). In the case of FIG. 1*b*, the plane of extension of said fastening section extends horizontally and at right angles to the plane of the drawing.

In the region of the fastening section, there are projections 7 and recesses 10 in frame halves 5, 4, which are in engagement with each other when the holding frame is in the assembled state.

Projections 7 of frame half 5 extend here in the plane of extension in the direction of frame half 4, or more precisely into the recesses 10 in frame half 4. Projections 7 and recesses 10 are each arranged at the outermost end of the fastening sections (in the longitudinal direction). Due to projections 7 locking the opposite frame half 4 in the plane of extension, in some measure, relative displacement along the longitudinal axis is thus prevented for frame half 4, 5 and hence also for side parts 8. In other words, the upper projection 7 in the view shown in FIG. 1*a* blocks any movement slantingly towards the top right (in the view shown), by engagement with the respective recess 10, whereas the lower projection 7 prevents any movement slantingly towards the bottom left (in the view shown), by engagement with the respective recess 10.

In an alternative or supplementary variant, the recess may also be slot-shaped, so engagement of even a single projection will prevent any lateral displacement of side parts 8 in either direction. Slot-shaped should be understood in such a way in this context that the recess has at least two opposite edges against which the projection abuts, thus preventing any lateral displacement. So this variant is not limited to just one slot as recess, as recesses in the shape of mushrooms, semicircles, triangles, etc. must also be considered slot-shaped.

When the frame halves are suitably dimensioned and designed, it is also possible for identical frame halves to be joined together to form one holding frame, each frame half then having one projection and one recess (at opposite ends).

Projection 7 is preferably so long, as in this embodiment, that engagement is not terminated even when holding frame 1 is folded out (see FIG. 2*b*), so that the prevention of any lateral movement is also maintained in the folded out state. This prevent the holding frame from being inadvertently split into its constituent halves.

FIGS. 1*a*, 1*b*, 2*a* and 2*b* show holding frames that are still without any elastic fixing elements, this view serving to better illustrate the basic structure of a holding frame according to the invention.

Without this having to be specially addressed in the following discussion of the individual embodiments, holding frames according to the invention can also have the function of securing themselves against falling apart as a result of the frame halves moving relative to each other in the longitudinal direction, as can be seen from FIGS. 1*a*, 1*b*, 2*a* and 2*b*. More particularly, the invention also includes the frame halves being designed in such a way that one frame half, in at least one fastening section, has a projection which protrudes in the direction of the other frame half and which engages with a recess in the fastening section of the other frame half in such a way that any lateral displacement of the side parts is prevented.

However, in contrast to the view shown in FIGS. 1*a*, 1*b*, 2*a* and 2*b*, the frame halves may also be embodied as die-cast elements made of zinc, in particular, that are substantially endowed with flexural rigidity, which means it is then possible to dispense with any securing function.

Elements in the embodiments that are substantially unchanged compared to the elements in the views shown in FIGS. 1*a*, 1*b*, 2*a* and 2*b*, or which are modified in a way that has no significance for the invention, and which reappear in the Figures discussed below, are marked with identical or similar reference signs and do not require additional discussion.

Figure 3A:
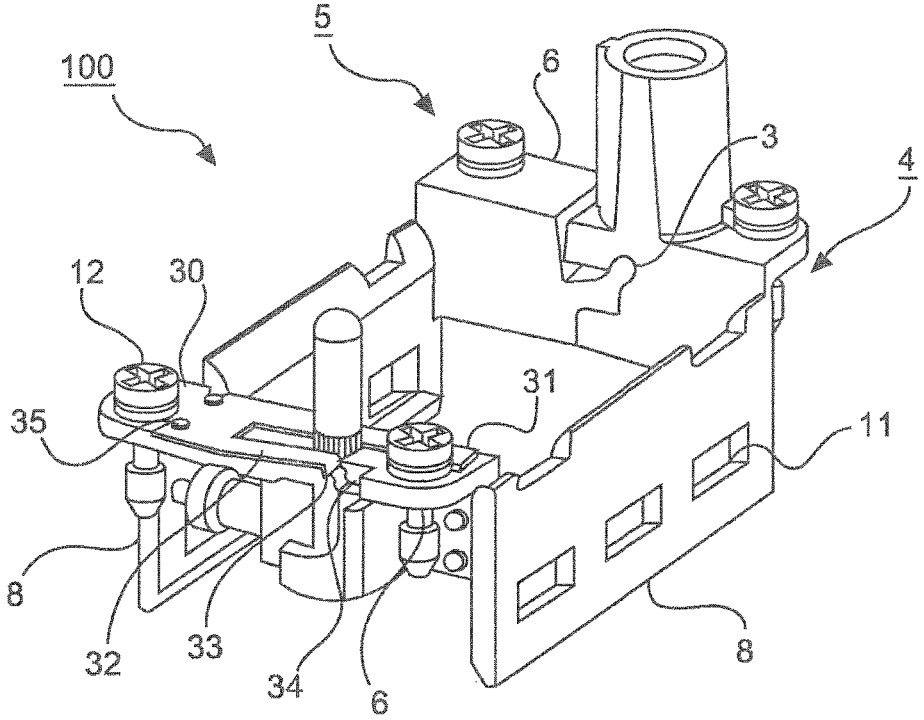
FIGS. 3*a* and 3*b* show views of a first embodiment of a holding frame according to the invention.
Figure 3B:
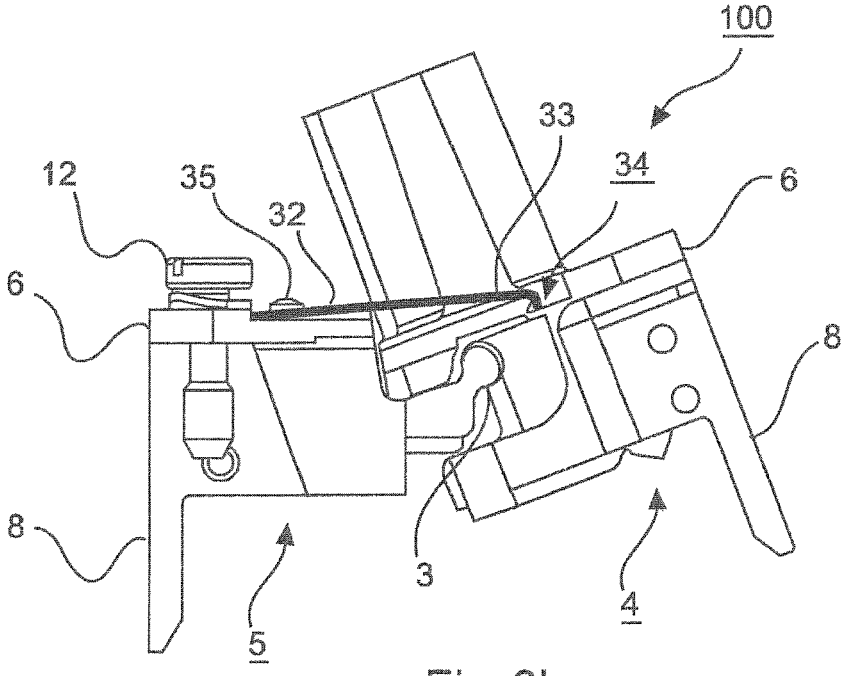

FIGS. 3*a* and 3*b* show views of a first embodiment of a holding frame according to the invention.

The basic design of holding frame 100 is the shape of an articulated frame as shown in FIGS. 1*a*, 1*b*, 2*a* and 2*b* or as also described in DE 197 07 120 C1 and EP 0 860 906 A2. On the plane of fastening screws 12 attached at fastening ends 6, a spring plate 30 is attached as an example of an elastic fixing element on one frame half 5 (here with rivets 35). Spring plate 30 has two fingers 31, 32. The two fingers 31, 32 of the spring plate extend into the region of the other, second frame half 4 and hold the latter in the closed position, i.e. in the holding state, as shown in FIG. 3*a*.

In order to bring holding frame 100 out of the holding state shown in FIG. 3*a* in the mounting position (plug-in state) for the modules, as shown in FIG. 3*b*, holding frame 100 is pivoted open against the force of spring plate 30, with the second finger 32 snapping into a recess 34 on the other frame half 4 and thus fixing holding frame 100 in the open position (plug-in state). Finger 32 is provided at its end with a catch 33 as an example of a detent member that engages with recess 34. Recess 34 is an example of an engagement member.

In order to release the fixed plug-in state, as illustrated in FIG. 3*b*, the catch 33 of finger 32 must be lifted out of recess 34 against the restoring force of finger 32 or spring plate 30, so that frame halves 4, 5 are brought into the holding state as a result of the spring action of spring plate 30.

One advantage of dividing spring plate 30 into two fingers 31, 32 is that, when finger 32 is lifted out of recess 34, the other finger 31 already starts to push the other frame half 4 towards the holding state (clockwise in FIG. 3*b*).

Differently from the embodiment shown in FIGS. 3*a* and 3*b*, both fingers of the spring plate can be provided with a catch that engages with the respective recess for fixing purposes, the catch of one finger and the respective recess in the other frame half serving to fix the plug-in state, and the catch of the other finger and the respective recess serving to fix the holding state.

It is likewise possible that the spring plate is not divided into two fingers, and has one catch which can engage with either one recess or with two recesses in order to fix one or both states.

Another modification can consist in the contact surface of the spring plate not being on the surface of fastening end 6, as shown in FIG. 3*b*, but at an edge of the other frame half, so that it is possible to use for fixing purposes any interaction between said edges and a projection on the spring plate. It can be seen in FIG. 3*b* that a spring plate mounted on frame half 5 would come into contact, if pivoted, with the lower edge of frame half 4 facing frame half 5 and would be put under tension in that event. In such a case, division of the spring plate could lead to one finger (comparable to finger 31) providing a restoring force acting in the direction of the holding state, the other, shorter finger (comparable to finger 32) comes free of the edge and achieves, with the inner edge of frame half 4 facing frame half 5, fixing that can be released by spreading open the shorter finger.

With the embodiment shown in FIGS. 3*a* and 3*b*, a two-part frame is provided that is brought into and latched into an open final position by spring force solely by turning the frame halves. It can spring back from the open final position into the closed position, and then remain in that position, (only) by releasing the detent finger.

This constellation can also be reversed by a suitable design (not shown), such that the spring plate causes a restoring force in the direction of the plug-in state when in a state between the plug-in state and the holding state, a catch or some other detent member being designed to engage with an engagement member (e.g. a recess) in the holding state.

In the case of the first embodiment, the detent member is a catch 33 and the engagement member 34 is a recess. However, the engagement member can also be formed by a projection or similar on the frame half, the detent member being an opening in the spring plate, for example. Combinations of a catch and a projection, or similar structures, are likewise possible.

Figure 4A:
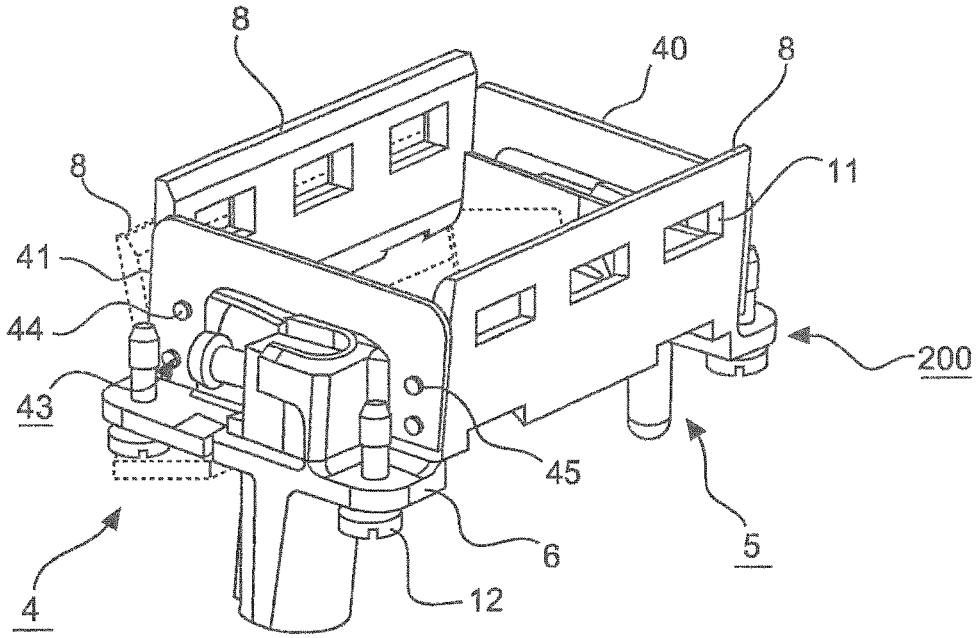
FIGS. 4*a* and 4*b* show views of a second embodiment of a holding frame according to the invention.
Figure 4B:
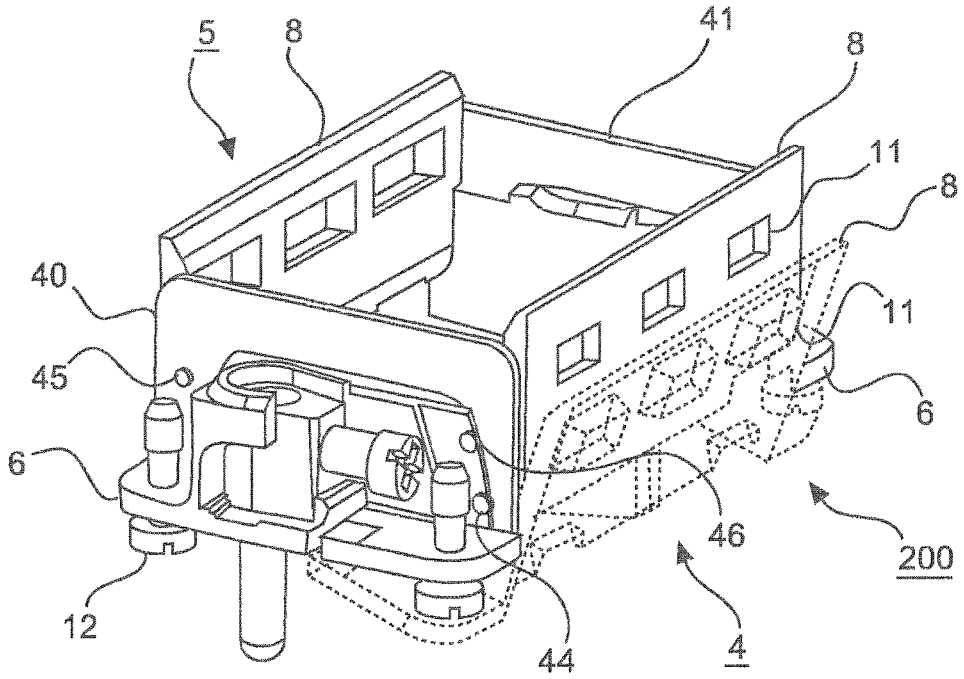

FIGS. 4*a* and 4*b* show views of a second embodiment of a holding frame according to the invention. The plug-in state (broken lines) and the holding state are shown here, FIGS. 4*a* and 4*b* differing in that they are shown from opposite viewing directions.

Similarly to the first embodiment, the basic design of holding frame 200 is the shape of an articulated frame as shown in FIGS. 1*a*, 1*b*, 2*a* and 2*b*, or as also described in DE 197 07 120 C1 and EP 0 860 906A2.

In a respective end plane that is perpendicular to a fastening surface (not shown, cf. fastening ends 6) and to the side parts 8 of holding frame 200, two different locking plates 40, 41 are provided as further examples of elastic fixing elements.

Locking plates 40, 41 are so designed that a cylindrical pin 44 of holding frame 4 can engage on the one side with two recesses 43, 46 on or in locking plate 40, 41. The other side is securely connected to the frame half (here by screw 45). The recesses are so designed that holding frame 200 is fixed in an open and a closed position.

Locking plates 40, 41 are different variants of an elastic fixing element and can be used either singly, in pairs or, as shown here, in a mixed form.

It can be seen in FIG. 4*a* that pin 44 extends in the holding state through the upper of the two recesses 43 of locking plate 41, whereas in the plug-in state it extends through the lower of the two recesses 43. There is therefore form-locking fixing in each case, which can be removed by prying locking plate 41 from the base member of the holding frame. Locking plate 41 thus has resilience in that direction and therefore can also be viewed as a spring plate.

It can be seen in FIG. 4*b* that, in the holding state and in the plug-in state, respectively, a corresponding pin 44 is located in a recess or notch 46 of locking plate 40, which is provided on the inner side of U-shaped locking plate 40. Locking plate 40 also has an elasticity in the end plane, so that sufficient force is exerted by slightly spreading the U-shape, pin 44 comes free of the respective notch 46 and can move along the leg of the locking plate to the respective other notch 46. There is no form-locking connection here, therefore, but only a force-locking connection.

One advantage of a combination of locking plates 40, 41 is that, for release in each case, it is not necessary to unlock both sides by spreading them apart, in order to bring the holding frame into the open or closed position.

Figure 5A:
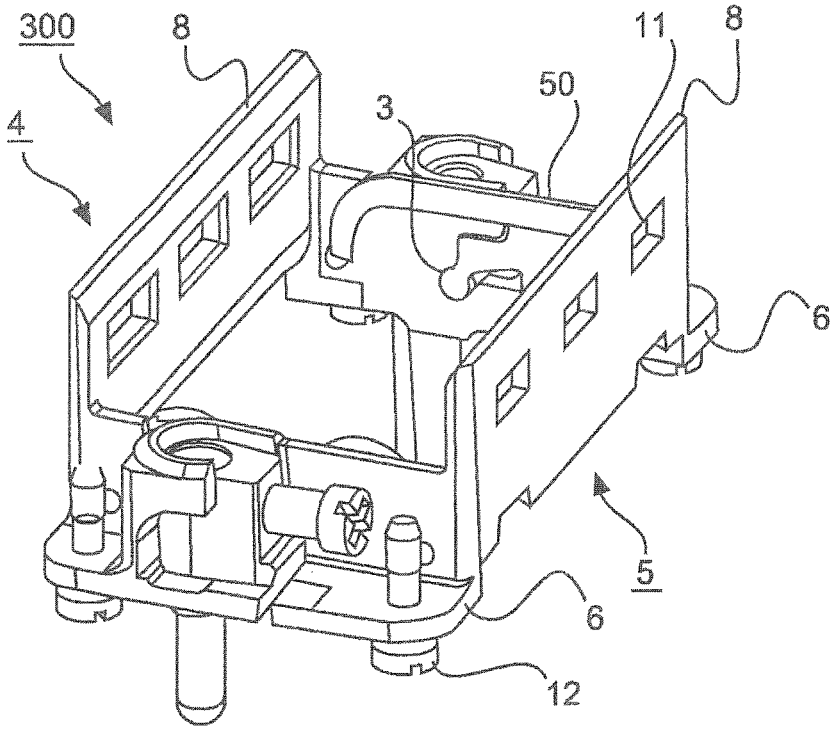
FIGS. 5*a*, 5*b* and 5*c* show views of a third embodiment of a holding frame according to the invention.
Figure 5B:
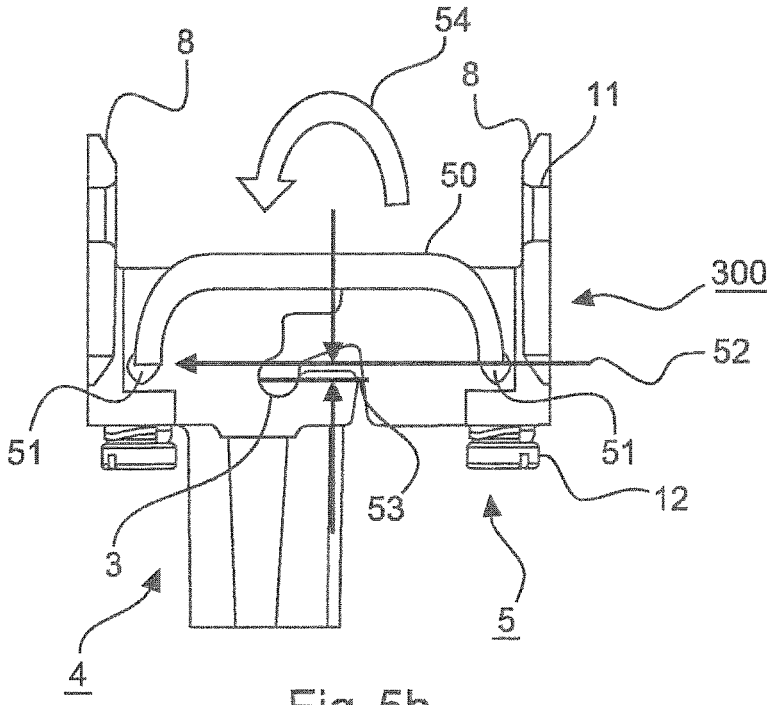
Figure 5C:
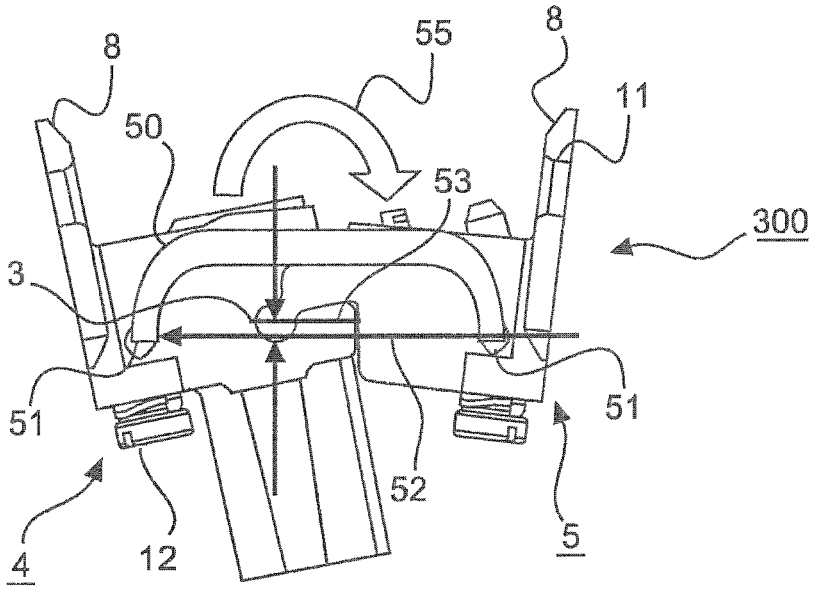

FIGS. 5*a*, 5*b* and 5*c* show views of a third embodiment of a holding frame according to the invention.

Similarly to the first and second embodiments, the basic design of holding frame 300 is the shape of an articulated frame as shown in FIGS. 1*a*, 1*b*, 2*a* and 2*b*, or as also described in DE 197 07 120 C1 and EP 0 860 906 A2.

Clamping springs 50 are provided in end face portions extending perpendicularly to a fastening surface (not shown, cf. fastening ends 6) and to side parts 8 of holding frame 300, each of the spring clips being provided on the inner side of the end face portions in such a way that a substantially flush surface is formed. This flush fit prevents canting or similar when inserting a plug-in module (not shown).

Each spring clip 50 is in itself an example of an elastic fixing element.

Spring clip 50 holds both frame halves 4, 5 under a particular biasing force.

As can be seen in FIG. 5*b*, a line of action 52 for the biasing force, as defined by end points 51 of spring clip 50 engaging at frame halves 4, 5, lies a certain amount above hinge 3 and/or above the pivot axis defined by hinge 3 and/or above a corresponding plane 53, in the closed state (holding state). This has the effect that holding frame 300 is held in the closed position, because a torque is exerted in the anticlockwise direction on hinge 3 due to the biasing force of the spring (cf. arrow 54).

If frame 300 is now brought into the open position (the plug-in state) against the biasing force in order to mount the modules (not shown), line of action 52 moves into the region below hinge 3 or plane 53, as shown in FIG. 5*c*, and thus causes holding frame 300 to pivot into the open position and stay in that position, since there is now an opposite torque acting on hinge 3 (cf. arrow 55).

The effect of the spring clip 50 used here can be described another way. The potential pivot range of frame halves 4, 5 relative to each other is limited by the constructional design of frame halves 4, 5 and of hinge 3 to the range between the holding state (FIG. 5*b*) and the plug-in state (FIG. 5*c*) (inclusively in each case). Frame halves 4, 5 and spring clip 50 are arranged and adapted in such a way that the distance between end points 51 (or points of attack) of the spring clip acquires an at least locally minimum value in the holding state and in the plug-in state. To proceed from the holding state to the plug-in state, it is therefore necessary to spread the spring clip open, against its respective restoring force. At at least one point between the holding state and the plug-in state, the distance between end points 51 is at a maximum, so that once that point is overcome, further pivoting is supported by the restoring force of spring clip 50. The maximum distance between the end points is preferably at one point only, which thus defines a labile maximum between the two states.

Figure 6A:
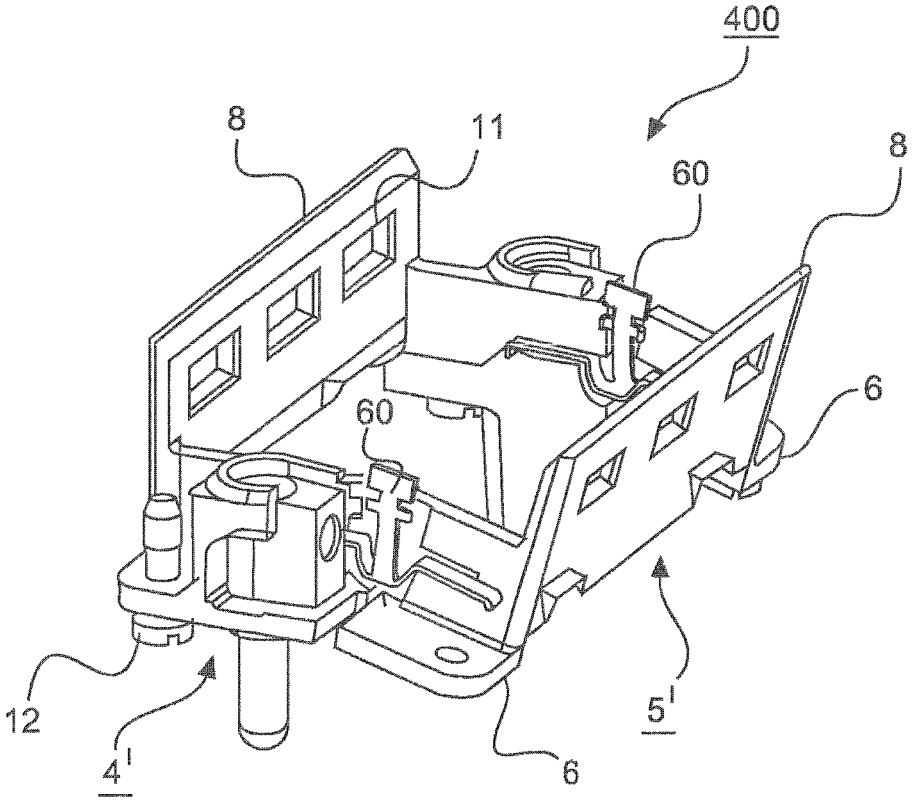
FIGS. 6*a*, 6*b* and 6*c* show views of a fourth embodiment of a holding frame according to the invention.
Figure 6B:
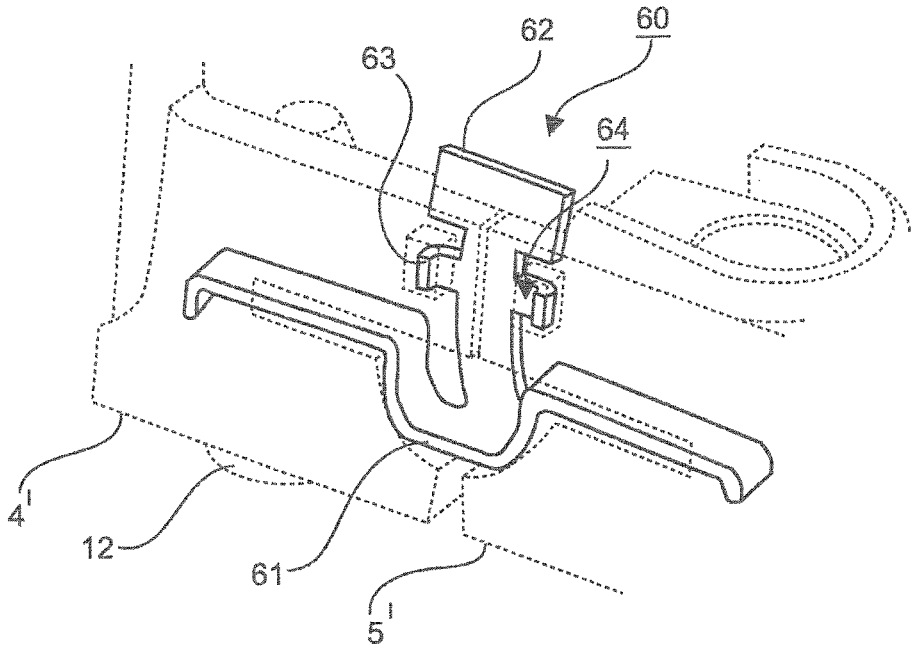
Figure 6C:
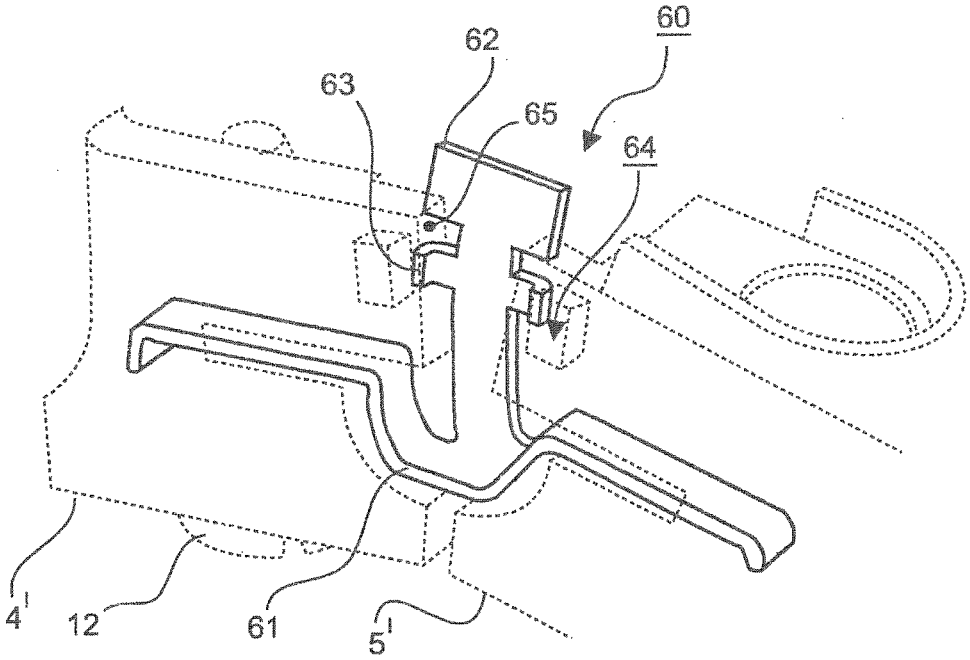

FIGS. 6*a*, 6*b* and 6*c* show views of a fourth embodiment of a holding frame according to the invention.

The basic design of holding frame 400 is similar to the shape of an articulated frame as shown in FIGS. 1*a*, 1*b*, 2*a* and 2*b* or as also described in DE 197 07 120 C1 and EP 0 860 906 A2. However, no hinge provided by a projection and a recess (see, for example, FIG. 1*b* or FIG. 2*b*) is provided here, in contrast to the first, second and third embodiments.

The articulated connections between frame halves 4', 5' of holding frame 400 is achieved here by part of an Omega spring 60, serving here as an example of an elastic fixing element.

Omega spring 60 includes a hinge portion 61 and a detent portion 62.

Hinge portion 61 extends into matching recesses in frame halves 4', 5' and in this embodiment, due to frame halves 4', 5' being pivoted out of the holding state (see FIG. 6*b*) into the plug-in state (see FIG. 6*c*), is imparted a bending stress that causes holding frame 400 to tend towards returning to the holding state.

Detent portion 62 is connected to hinge portion 61 and allows elastic deformation along the longitudinal axis of the holding frame, against a restoring force, so that bending stress can be established.

In the holding state. two projections 63 of detent portion 62 extend into respective recesses 64 in frame halves 4', 5', such that the holding frame is fixed in the holding state by a locking mechanism, in addition to the action of hinge portion 61.

In order to release that fixing or locking, detent portion 62 is bent so that projections 63 come free of recesses 64. By releasing it in this way, the holding frame can be spread open against the restoring force applied by the hinge portion, and can thus be brought into the plug-in state.

If detent portion 62 is released in the plug-in state, projections 63 move between the inner edges 65 of frame halves 4', 5', with the result that any return of holding frame 400 to the holding state is prevented by interaction of inner edges 65 (and/or any recesses therein) with projections 63.

It is not until detent portion 62, or projections 63 of detent portion 62 are removed by bending detent portion 62 accordingly out of the region between the frame halves that the transition from plug-in state to the holding state can be carried out.

The frame halves may be of identical design, since the asymmetry provided by the hinge in the other embodiments is no longer needed.

Figure 7:
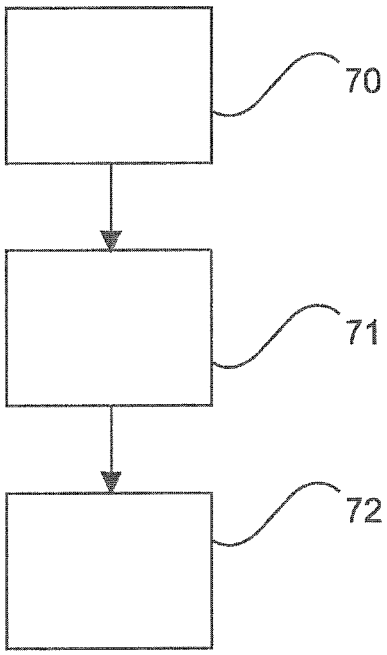
FIG. 7 shows a flow diagram illustrating an embodiment of a production method according to the invention and FIG. 8 shows a flow diagram illustrating an embodiment of a populating method according to the invention.

FIG. 7 shows a flow diagram illustrating an embodiment of a production method according to the invention.

The production method is used for producing a holding frame according to the invention, i.e. a holding frame for holding plug connector modules, such that the plug connector modules are insertable into the holding frame, and holding means on the plug connector modules can cooperate with holding means which are provided on opposite side parts of the holding frame.

In a first step 70, two frame halves are provided, each comprising one side part of the holding frame; in the next step 71, the frame halves are articulatedly connected to each other, the hinged connection allowing a plug-in state and a holding state of the holding frame, the frame halves in the plug-in state being pivoted in relation to each other about a longitudinal axis in such a way that one or more plug connector modules can be introduced between the side parts, the frame halves in the holding state being pivoted in such a way relative to the plug-in state that one or more inserted plug connector modules have a form-locking connection with the holding frame.

The method also includes the step of affixing 72 at least one fixing element adapted to releaseably fix the frame halves in the plug-in state and the holding state, wherein a restoring force of the elastic fixing element must be overcome at least in order to release the fixing and/or to switch between the plug-in state and the holding state.

Affixing 72 the elastic fixing element is done by a form-locking, force-locking and/or material-fit connection.

The sequence of steps 70, 71 and 72 is not necessary for the production method. Affixing step 72, for example, can also be part of the step 70 that involves providing the frame halves, and/or may be performed between steps 70 and 71.

Figure 8:
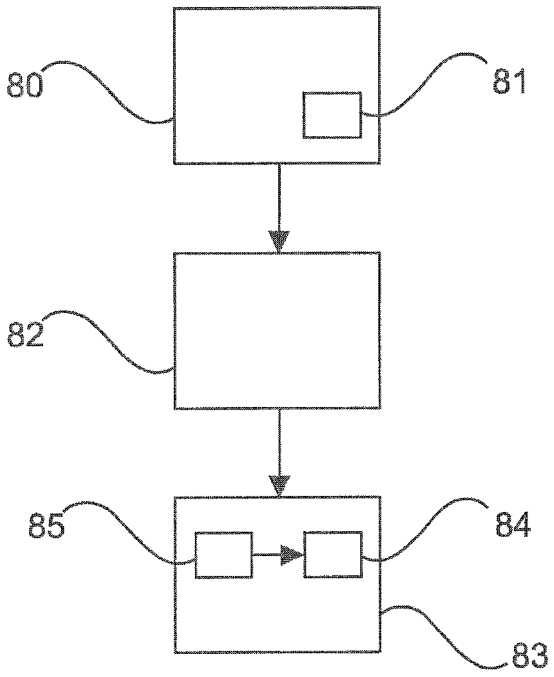

FIG. 8 shows a flow diagram illustrating an embodiment of a populating process according to the invention.

The method according to the invention for populating a holding frame with plug connector modules, in particular a holding frame as described above and shown in the Figures, comprises the following steps:

Firstly, in step 80, a plug-in state of the holding frame is provided, the frame halves articulatedly connected to each other at fastening ends of the holding frame in the plug-in state being pivoted in relation to each other about a longitudinal axis in such a way that one or more plug connector modules can be introduced between the side parts.

The step of providing 80 includes releaseably fixing 81 the frame halves to each other by means of an elastic fixing element.

In the plug-in state, the holding frame can be populated with one or more plug connector modules in a populating step 82.

Populating 82 is followed by providing 83 a holding state of the holding frame, by pivoting the frame halves relative to the plug-in state, so that the one or more inserted plug connector modules have a form-locking connection with the holding frame via holding means on the plug connector modules and via holding means which are provided on opposite side parts of the holding frame.

Providing 83 the holding state includes releaseably fixing 84 the frame halves to each other by means of the elastic spring element.

Fixing 84 in the holding state is preceded by overcoming 85 a restoring force of the elastic fixing element at least in order to release the fixing in the plug-in state and/or to switch between the plug-in state and the holding state.

The invention preferably allows an open and unequivocally fixed frame position for installing or inserting the modules. After the modules have been inserted into the frame and the frame halves have been positioned in the closed state, the latter is secured against unintentional opening, within certain limits, or at least under normal handling, without any additional securing element having to be mounted. In various configurations, a defined electrical contract between the frame halves is achieved by the elastic fixing element.

Fixation of the frame halves in the open/closed state can thus be integrated in the holding frame itself, so there are no separate parts that can be lost. Inadvertent opening of the frame halves after installation or insertion of the module is thus prevented by means of a spring force.

The invention claimed is:

1. A holding frame for holding plug connector modules, wherein said plug connector modules are insertable into the holding frame, and holding projections on the plug connector modules cooperate with holding recesses which are provided on opposite side parts of the holding frame, wherein the holding frame includes two frame halves articulatedly connected to each other at fastening ends of the holding frame, the holding frame being divided along a line parallel to the side parts of the holding frame, a hinged connection allowing the holding frame a plug-in state and a holding state, the frame halves in the plug-in state being pivoted in relation to each other about a longitudinal axis in such a way that one or more plug connector modules can be introduced between the side parts, and the frame halves in the holding state being pivoted in such a way relative to the plug-in state that one or more inserted plug connector modules have a foil i-locking connection with the holding frame, wherein the holding frame has an elastic fixing element adapted to releaseably fix the frame halves in the plug-in state and the holding state, wherein a restoring force of the elastic fixing element must be overcome at least in order to release the fixing and/or to switch between the plug-in state and the holding state.

2. The holding frame according to claim 1, wherein the elastic fixing element includes a spring plate which is mounted on one frame half and comprises a detent member for engagement with an engagement member of the other frame half.

3. The holding frame according to claim 2, wherein a) the spring plate is designed to cause a restoring force in the direction of the holding state when in a state between the plug-in state and the holding state, and the detent member is designed to engage with the engagement member in the plug-in state, or b) the spring plate is designed to cause a restoring force in the direction of the plug-in state when in a state between the plug-in state and the holding state, and the detent member is designed to engage with the engagement member in the plug-in state.

4. The holding frame according to claim 2, wherein a restoring force of the spring plate must be counteracted to release the engagement of the detent member and the engagement member.

5. The holding frame according to claim 2, wherein the other frame half has a first and a second engagement member and the detent member is designed to engage with the first and the second engagement member, or the spring plate has a second detent member.

6. The holding frame according to claim 1, wherein the hinged connection is so designed that a distance between a first section of the one frame half and a second section of the other frame half adopts an extreme value during a transition between the plug-in state and the holding state, the first and the second section being coupled to each other via the elastic fixing element.

7. The holding frame according to claim 6, wherein the elastic fixing element is a spring clip which is arranged, in particular, in a plane defined by a fixing element.

8. The holding frame according to claim 6, wherein the first section of the one frame half and the second section of the other frame half are coupled to each other via the elastic fixing element, a pivot axis of the hinged connection being located between a connecting line between the first and the second section in the plug-in state, and a connecting line between the first and the second section in the holding state.

9. The holding frame according to claim 8, wherein the elastic fixing element is a spring clip which is arranged, in particular, in a plane defined by a fixing element.

10. The holding frame according to claim 1, wherein a first section of the one frame half and a second section of the other frame half are coupled to each other via an elastic spring element, a pivot axis of the hinged connection being located between a connecting line between the first and the second section in the plug-in state, and a connecting line between the first and the second section in the holding state.

11. The holding frame according to claim 1, wherein the elastic fixing element includes a detent portion, the hinge portion articulatedly connecting the frame halves to each other so that in the plug-in state a first hinge restoring force acts in the direction of the holding state and/or a second hinge restoring force acts in the holding state in the direction of the plug-in state, wherein in a detent position the detent portion holds the frame halves in the plug-in state against the first hinge restoring force, or in the holding state against the second hinge restoring force, and wherein the detent portion can be brought from the detent position into a released position against the detent restoring force, in which the detent portion allows a transition between the holding state and the plug-in state.

12. The holding frame according to claim 11, wherein the hinge portion and the detent portion are embodied together in one piece as elements of the elastic fixing element.

13. The holding frame according to claim 12, wherein the hinge portion is relaxed in the plug-in state or in the holding state, the detent portion being designed to fix the frame halves in place when the hinge portion is relaxed.

14. The holding frame according to claim 12, wherein the hinge portion is designed so that the plug-in state or the holding state is maintained by the first or second hinge restoring force.

15. The holding frame according to claim 11, wherein the hinge portion is relaxed in the plug-in state or in the holding state, the detent portion being designed to fix the frame halves in place when the hinge portion is relaxed.

16. The holding frame according to claim 11, wherein the hinge portion is designed so that the plug-in state or the holding state is maintained by the first or second hinge restoring force.

17. The holding frame according to claim 1, wherein the elastic fixing element connects the frame halves electrically to each other in the holding state at least.

18. A method for producing a holding frame for holding plug connector modules, such that the plug connector modules are insertable into the holding frame, and holding projection on the plug connector modules can cooperate with holding recesses which are provided on opposite side parts of the holding frame, said method comprising the steps of:

providing two frame halves each comprising one side part of the holding frame, and articulatedly connecting the frame halves to each other along the side parts of the holding frame at fastening ends, the hinged connection allowing a plug-in state and a holding state of the holding frame, the frame halves in the plug-in state being pivoted in relation to each other about a longitudinal axis in such a way that one or more plug connector modules can be introduced between the side parts, the frame halves in the holding state being pivoted in such a way relative to the plug-in state that one or more inserted plug connector modules have a form-locking connection with the holding frame, said method comprising affixing an elastic fixing element adapted to releaseably fix the frame halves in the plug-in state and the holding state, wherein at least a restoring force of the elastic fixing element must be overcome in order to release the fixing and/or to switch between the plug-in state and the holding state, the elastic fixing element being affixed by a form-locking, force-locking and/or material-fit connection.

19. A method for populating a holding frame with plug connector module, wherein the holding frame includes two frame halves, the holding frame being divided along a line parallel to the side parts of the holding frame, said method comprising the steps of:

providing a plug-in state of the holding frame, the frame halves articulatedly connected to each other at fastening ends of the holding frame in the plug-in state being pivoted in relation to each other about a longitudinal axis in such a way that one or more plug connector modules can be introduced between the side parts, wherein providing the plug-in state includes releaseably fixing the frame halves to each other by an elastic fixing element, populating the holding frame in the plug-in state with one or more plug connector modules, and providing a holding state of the holding frame by pivoting the frame halves relative to the plug-in state, so that the one or more inserted plug connector modules have a form-locking connection with the holding frame-via holding projections on the plug connector modules and via holding recesses which are provided on opposite side parts of the holding frame, wherein providing the holding state includes releaseably fixing the frame halves to each other by the elastic spring element, wherein providing the holding state at least includes overcoming a restoring force of the elastic fixing element in order to release the fixing in the plug-in state and/or to switch between the plug-in state and the holding state.

* * * * *